US009273696B2

(12) United States Patent
Kampf

(10) Patent No.: US 9,273,696 B2
(45) Date of Patent: Mar. 1, 2016

(54) AXIAL FAN, FAN ROTOR AND METHOD OF MANUFACTURING A ROTOR FOR AN AXIAL FAN

(75) Inventor: Lars Verner Kampf, Næstved (DK)

(73) Assignee: NOVENCO A/S, Naestved (DK)

( * ) Notice: Subject to any disclaimer, the term of this patent is extended or adjusted under 35 U.S.C. 154(b) by 560 days.

(21) Appl. No.: 13/498,741

(22) PCT Filed: Oct. 13, 2010

(86) PCT No.: PCT/DK2010/050264

§ 371 (c)(1),
(2), (4) Date: May 4, 2012

(87) PCT Pub. No.: WO2011/044908

PCT Pub. Date: Apr. 21, 2011

(65) Prior Publication Data

US 2012/0219414 A1 Aug. 30, 2012

(30) Foreign Application Priority Data

Oct. 13, 2009 (DK) ..... 2009 01117

(51) Int. Cl.

| | |
|---|---|
| ***F04D 19/00*** | (2006.01) |
| ***B23P 15/04*** | (2006.01) |
| ***F04D 29/32*** | (2006.01) |
| ***F04D 29/02*** | (2006.01) |
| ***F04D 29/38*** | (2006.01) |

(52) U.S. Cl.

CPC ..... *F04D 29/329* (2013.01); *F04D 29/023* (2013.01); *F04D 29/388* (2013.01); *Y10T 29/49327* (2015.01)

(58) Field of Classification Search

CPC ... F04D 29/023; F04D 29/526; F04D 29/545; F04D 29/646

USPC ..... 415/182.1, 218.1, 219.1, 220; 416/204 R, 213 R, 214 R, 244 R

See application file for complete search history.

(56) References Cited

U.S. PATENT DOCUMENTS 2,022,417 A 11/1935 Gilbert et al.
2,488,945 A * 11/1949 Troller et al. ..... 417/423.14

(Continued)

FOREIGN PATENT DOCUMENTS

EP 1 253 289 A2 10/2002
JP A-2004-116291 4/2004

OTHER PUBLICATIONS

Search Report issued in Danish Patent Application No. PA 2009 01117 dated May 25, 2010 (with translation).

(Continued)

*Primary Examiner* — Igor Kershteyn
*Assistant Examiner* — Woody A Lee, Jr.
(74) *Attorney, Agent, or Firm* — Oliff PLC

(57) ABSTRACT

An axial fan and a fan rotor are provided as well as a method of manufacturing same, wherein the rotor hub includes an outer shell having on its outside a hub surface which is essentially rotational-symmetrical about the center axis of the rotor hub; and wherein the rotor hub has a front end and a rear end and a diverging section there between, where the radius of the hub surface in the diverging section is increased by the distance to the front end on the hub; and wherein the rotor hub and the blades are made as separate metal parts; and wherein the rotor blades are securely mounted to the diverging section on the hub surface.

12 Claims, 7 Drawing Sheets

(56) References Cited

U.S. PATENT DOCUMENTS

Figure 1:
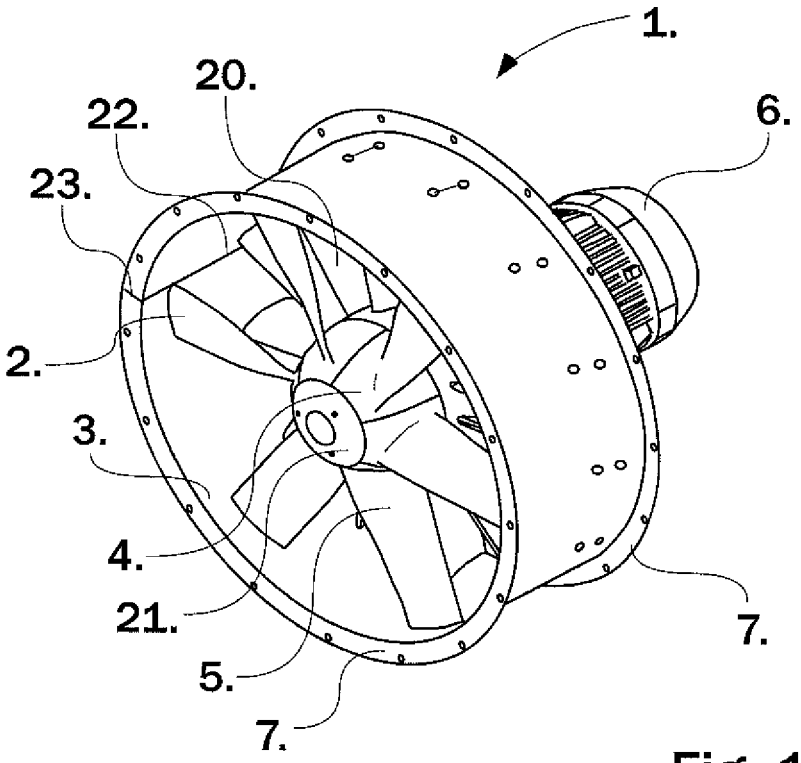

| | | | | | |
|---|---|---|---|---|---|
| 2,596,781 | A | * | 5/1952 | Moore | 416/213 R |
| 3,002,266 | A | * | 10/1961 | Lynn et al. | 29/889.6 |
| 3,085,632 | A | | 4/1963 | Schwegler | |
| 3,229,896 | A | | 1/1966 | Levy | |
| 3,300,123 | A | | 1/1967 | Freyholdt et al. | |
| 4,040,769 | A | * | 8/1977 | Britz | 416/213 A |
| 4,895,489 | A | * | 1/1990 | Kohama et al. | 415/218.1 |
| 5,573,376 | A | | 11/1996 | Hayden et al. | |
| 5,816,781 | A | * | 10/1998 | Bercot et al. | 417/371 |
| 6,352,407 | B2 | * | 3/2002 | Hill et al. | 416/144 |
| 2003/0206800 | A1 | | 11/2003 | Mathson et al. | |

OTHER PUBLICATIONS

International Search Report issued in International Patent Application No. PCT/DK2010/050264 dated Mar. 31, 2011.

International Preliminary Report on Patentability issued in International Patent Application No. PCT/DK2010/050264 dated Jan. 23, 2012.

May 28, 2014 Office Action issued in Chinese patent application No. 2010800458842 (with English Translation).

* cited by examiner

AXIAL FAN, FAN ROTOR AND METHOD OF MANUFACTURING A ROTOR FOR AN AXIAL FAN

FIELD OF USE OF THE INVENTION

The present invention relates to axial fans and in particular to a fan rotor for an axial fan and a method of manufacturing same.

Most often, an axial fan comprises an essentially circular-cylindrical blower pipe having an internal diameter and wherein the blower pipe is configured with a fan rotor, which fan rotor has a rotor shaft which essentially coincides with the centre axis of the circular-cylindrical blower pipe, and wherein the fan rotor comprises a centrally arranged rotor hub which, via a rotor shaft, is connected to a motor drive, and a number of rotor blades, each of which extends completely or partially radially from the rotor hub and towards the circular-cylindrical blower pipe, and wherein each blade has a proximal end secured to the rotor hub, and a distal end at the outer diameter of the rotor which is slightly smaller than the internal diameter of the blower pipe, and wherein the blower pipe is provided with mounting flanges both upstream and downstream of said rotor, said mounting flanges extending essentially at right angles to the outside of the blower pipe, said mounting flanges comprising means for mounting the fan rotor in eg a tubing system for ventilation purposes.

STATE OF THE ART

Today several different embodiments of axial fans of the above-mentioned type are known.

It thus is a constant challenge in the development of such axial fans to achieve that, all other things being equal and at a given motor power for driving the fan rotor, the highest possible pressure increase is achieved, and/or the highest possible air throughput, while simultaneously the production costs associated with the manufacture of the axial fan are kept as low as possible.

OBJECT OF THE INVENTION

Based on that, it is the object of the present invention to provide an axial fan of the kind described above which, to a higher degree than known axial fans, enables that a high degree of efficiency is obtained for the axial fan without this necessitating high incremental costs for the manufacture of the axial fan.

According to the invention, this is accomplished by means of an axial fan and a fan rotor as set forth above and which are characterised in that the rotor hub comprises an outer shell having on its outside a hub surface which is essentially rotational-symmetrical about the centre axis of the rotor hub; and wherein the rotor hub has a front end and a rear end and a diverging section there between; wherein the radius of the hub surface in the diverging section is increased by the distance to the front end on the hub; and wherein the rotor hub and the blades are made as separate metal parts; and wherein the rotor blades are securely mounted to the diverging section on the hub surface.

Thereby it is also enabled that the fan rotor as such can be manufactured optimally with regard to efficiency in a given operating scenario; and that the rotor can be made from very few partial components without this entailing the need to compromise on configuration and optimisation of the individual rotor to different operating conditions.

The optimal securing of the blades to the hub surface is obtained if the blades are welded or soldered to the hub surface.

A preferred embodiment which yields a particularly high degree of freedom with a view to optimising the efficiency of the fan rotor is accomplished if the hub further comprises a shaft part extending within the outer shell along the centre axis of the rotor hub, which shaft part comprises means for mounting of the rotor hub on a dive shaft and being connected to the outer shell at the front end thereof; and wherein, for each individual blade on the fan rotor, there is configured a first reinforcement rib extending between the shaft part and the outer shell and supporting the outer shell underneath the blade relative to the shaft part.

In this context, there is further advantageously also provided, for each blade, two or more further reinforcing ribs that likewise extend between the shaft part and the outer shell and are arranged next to the first reinforcement rib in such a way that they support areas on the outer shell to both sides of the area that that is supported by the first reinforcing rib. This entails a particularly high degree of freedom with regard to securing the blade on the hub surface at any desired angle or position to the effect that the outer shell on the rotor hub is supported underneath the area where the blade is secured to the hub surface, irrespective of the selected position or angle.

As mentioned above, the present invention further relates to a method of manufacturing a fan rotor, which fan rotor comprises a hub and a number of blades; and wherein the rotor hub has an essentially rotational-symmetrical hub surface; and wherein the rotor hub has a front end and a rear end and a diverging section there between; wherein the radius of the hub surface in the diverging section is increased by the distance to the front end on the hub. According to the invention, this method is characterised in that the rotor hub and the blades are first made as separate parts of metal; and wherein each of the rotor blades has a proximal and a distal end; and wherein the proximal end of each blade is to be welded or soldered to the hub surface; and wherein, for each blade, a position and an orientation are selected with which the blade is to be welded or soldered to the hub surface, following which the proximal end of each blade is formed such that it can be welded to the hub surface in the selection position, and subsequently each blade can be secured by welding or soldering in its selected position.

As mentioned above, this provides a particularly high degree of freedom with respect to designing the fan rotor to a specific purpose, since it is possible, by means of few standard components, to build a fan or a fan rotor which is optimised to a given operation purpose. This is accomplished in that it is possible, by one single hub configuration and one blade configuration, to construct a number of different rotors by specifically selecting the position and/or the angle with which the blade is to be secured to the hub surface of the rotor hub in order for the finished fan rotor to be most optimal to a given purpose.

The method is further advantageous if, in the production of the fan rotor, a desired rotor diameter is selected and if the distal end of each blade is configured such that each blade protrudes precisely completely within the selected rotor diameter, seen with centre in the centre axis of the fan rotor.

The subsequent forming of the distal end of the blades can advantageously be made after the blades have been welded or soldered to the hub surface in the selected position. Thereby it is accomplished that the rotor can be made with very small tip clearance between the distal ends of the blades and the blower pipe that encircles the blade after mounting thereof in the axial fan.

A preferred embodiment, by which a high degree of freedom is accomplished for designing both rotor blades and rotor hub, is accomplished if both hub and blades are made in a moulding process.

In this context, rotor blades and the rotor hub can advantageously be made essentially from aluminium or an alloy comprising aluminium.

LIST OF FIGURES

FIG. 1: is a perspective view of an axial fan according to the present invention, seen in an inclined view from above.

Figure 2:
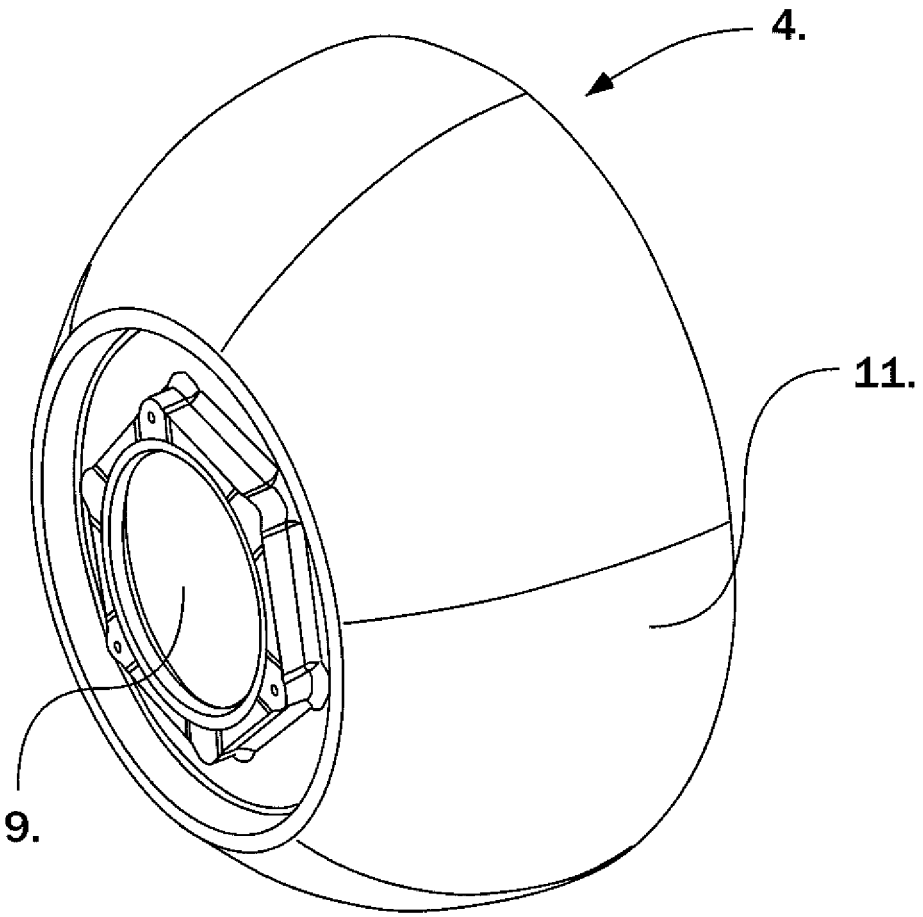

FIG. 2: is a perspective view of a fan rotor hub according to the invention, seen in an inclined view from the front and from above.

Figure 3:
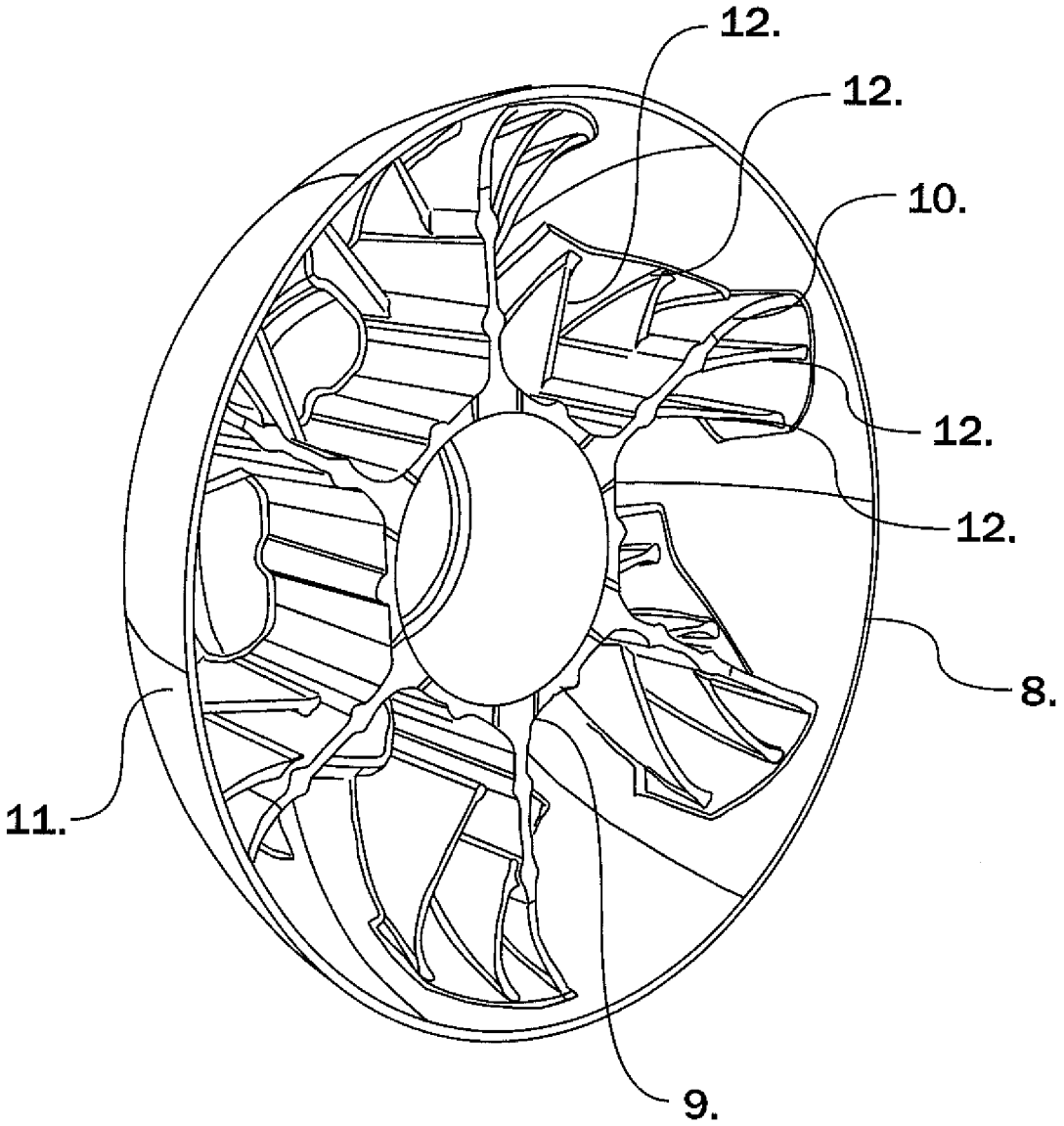

FIG. 3: is a perspective view of the rotor hub shown in FIG. 2, seen in an inclined view from behind and from above.

Figure 4:
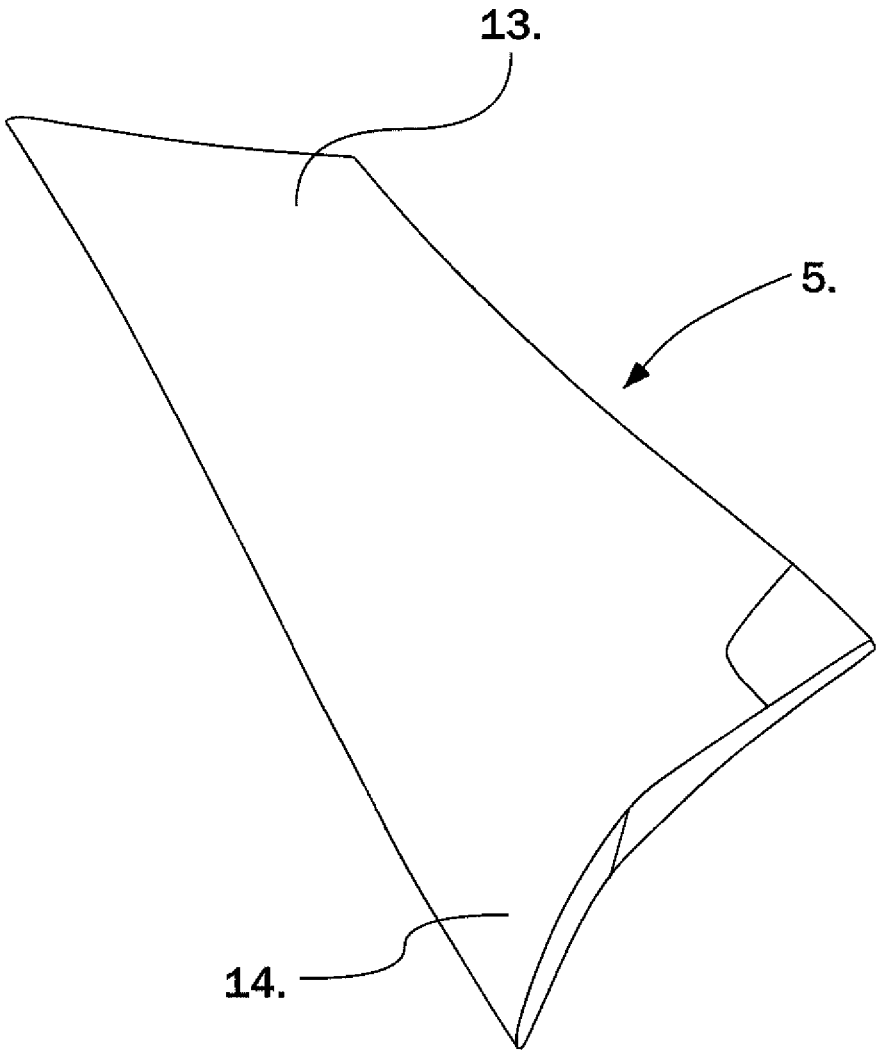

FIG. 4: is a perspective view of a fan rotor blade according to the invention, seen in an inclined view from above and from the front.

Figure 5:
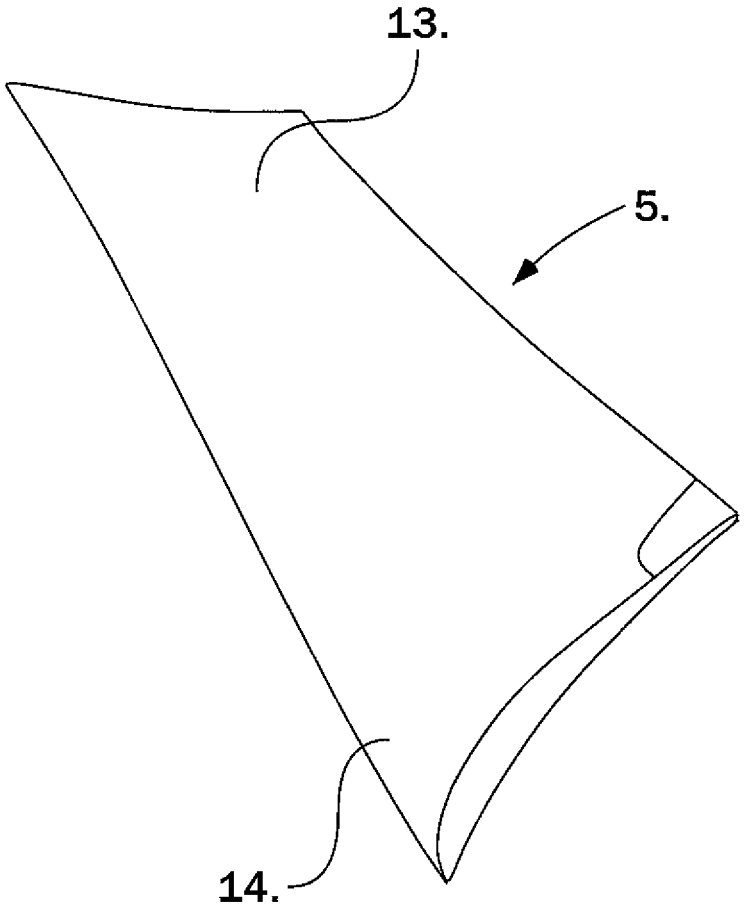

FIG. 5: is a perspective view of the blade shown in FIG. 3, following forming, seen in an inclined view from above and from the front.

Figure 6:
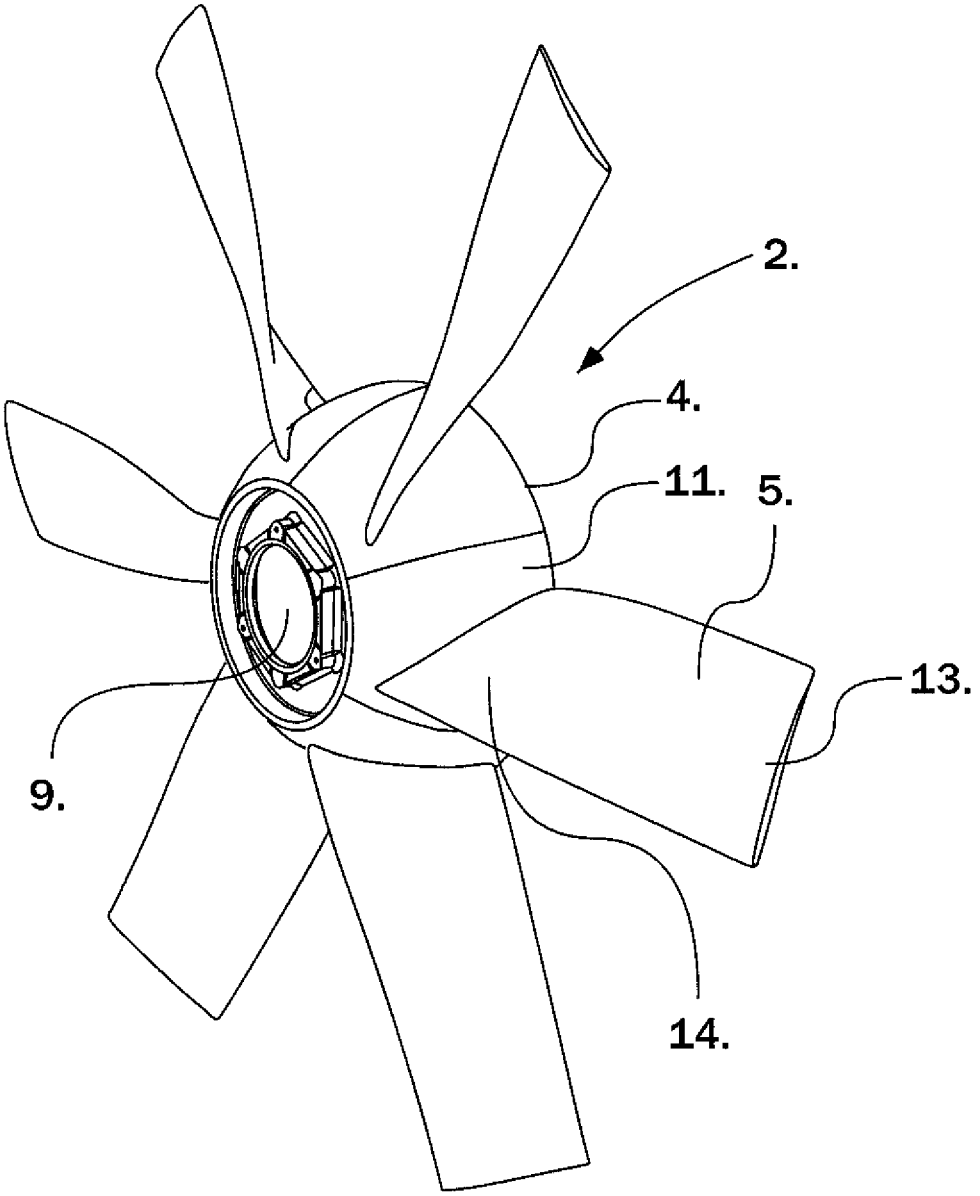

FIG. 6: is a perspective view of a not finished fan rotor, seen in an inclined view from above and from the front.

Figure 7:
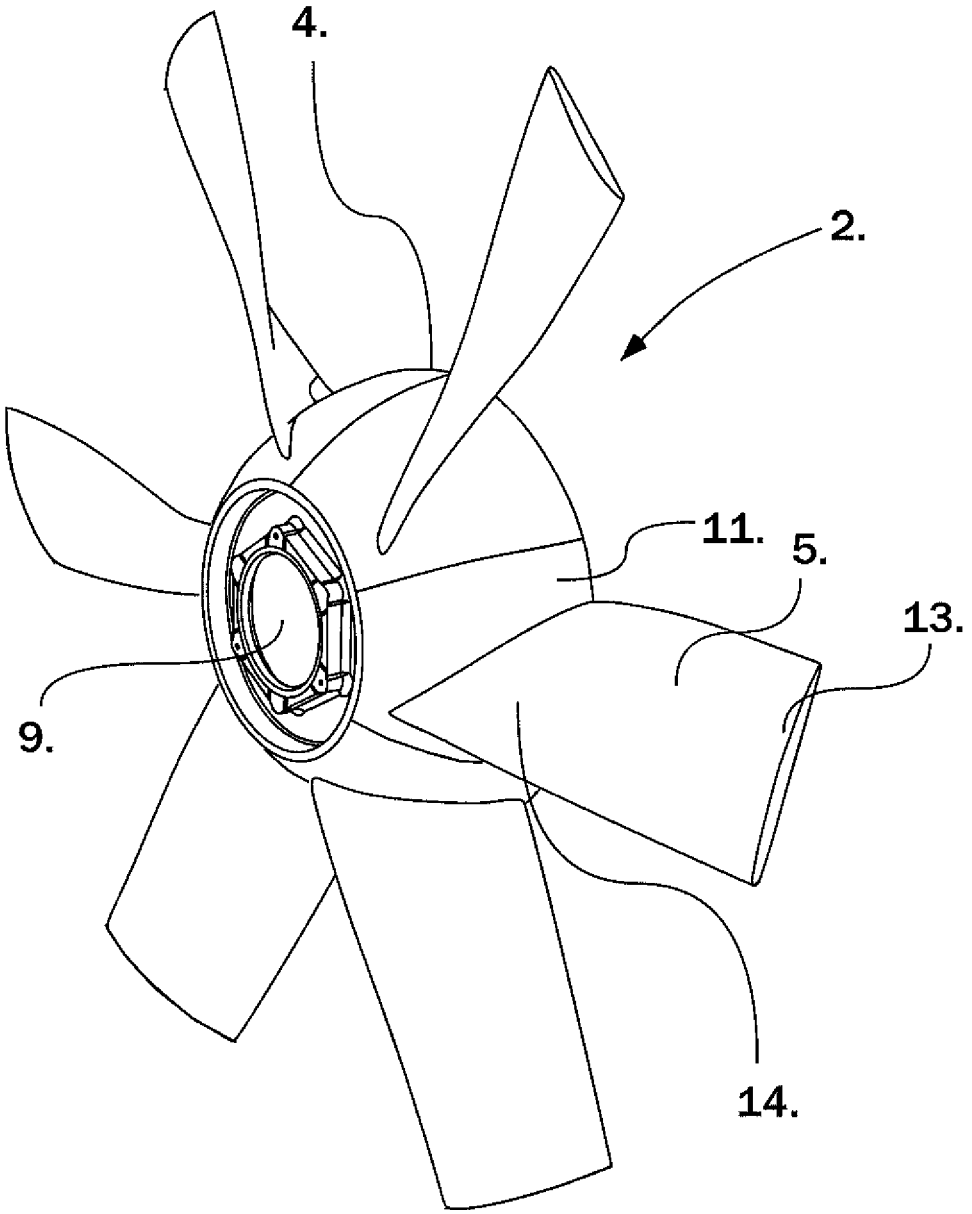

FIG. 7: is a perspective view of the fan rotor shown in FIG. 6 following forming, for mounting in an axial fan as shown in FIG. 1, seen in an inclined view from above and from the front.

EMBODIMENT OF THE INVENTION

Thus, FIG. 1 shows an axial fan 1 according to the present invention, said axial fan 1 having a fan rotor 2 in the form of a propeller which is driven by a motor 6, said fan rotor 2 having a rotor hub 4 which is mounted to a not shown rotor shaft which is driven by the motor 6 about the centre axis of the rotor 2.

The rotor 2 is located centrally in a blower pipe 3 which has, at both its ends, a mounting flange 7 extending outwards from the blower pipe 3 and being provided with bolt holes for mounting of the axial fan 1 in a tubing system, such as a ventilation tubing system, where it serves to propel air through the tubing system.

Moreover, the rotor 2 has a set of rotor blades 5 extending radially outwards from the rotor hub 4 and out towards the blower pipe 3 where the rotor blades 5 end a short distance from the inner side of the blower pipe 3 to the effect that the smallest possible tip clearance is established between the outermost end of the rotor blades 5 and the inner side of the blower pipe 3.

The fan rotor 2 as such is configured with a rotor hub 4 having a hub surface 11 that diverges outwardly in a direction from the front end of the rotor hub 4 and rearwards in a direction towards the rear end of the rotor hub 4. In the shown embodiment, the rotor hub 4 is configured as a part of a paraboloid, but, in accordance with the invention, the shape may be varied with regard to optimising the shape of the rotor hub 4 to a given purpose.

According to the invention, the blades 5 are securely mounted to the rotor hub 4, eg by welding or soldering, and this makes it possible for the rotor hub 4 and the blades 5 to be manufactured as independent units that are subsequently assembled to the effect that it is enabled, while using the same constituent components, to produce different fan rotors 2 that are optimised to specific purposes.

This is accomplished as shown in the following figures where FIG. 2 and show the rotor hub 4, seen in an inclined view from the front and from behind, respectively; FIG. 2, however, showing the rotor hub 4 without the rotor cover 21 shown in FIG. 1.

FIGS. 2 and 3 thus show the rotor hub 4 as an independent constituent component for constructing a finished fan rotor 2, and it will appear that the rotor hub 4 has an outer shell 8 which has, on its outside, an hub surface 11 being, in this embodiment, configured as a paraboloid and on which the rotor blades 5 are to be secured, eg by welding or soldering.

In the context of this, it is important to set forth that fan rotors in axial fans are very often caused to rotate at a very high numbers of revolutions; and that they are often exposed to very severe loads. Therefore, there is configured a reinforcing rib 10 within the outer shell 8 of the fan rotor everywhere where a rotor blade 5 is to be mounted; and each of the reinforcing ribs extends between the shaft part 9 and the outer shell 8 on the fan rotor 2. The shaft part being configured for mounting on a rotor shaft (not shown), the reinforcing ribs 10 will brace the external shell 8 and hence each of the rotor blades 5.

Since it is desired, in accordance with the invention, that the rotor blades 5 shall be capable of being mounted at different angles to the hub surface 11 of the fan rotor 2, further reinforcing ribs 12 are provided, as shown in FIG. 3, that extend in the same manner between the shaft part 9 and the outer shell 8 in areas that are located to both sides of the above-mentioned reinforcing ribs, so obviously this means that it is possible to do so without weakening the outer shell 8 and the attachment of the rotor blades 5 on the hub surface 11 no matter at which angle, within a given interval, the rotor blades 5 are mounted to the hub surface.

Now, FIGS. 4 and 5 show a rotor blade 5, and it will appear from FIG. 4 that each of the rotor blades is manufactured as a constituent component which cannot immediately be mounted to the hub surface 11, as in particular the proximal end 14 of the rotor blade 5, which is intended for being mounted to the hub surface by welding or soldering, is not configured such as to snugly adjoin the hub surface no matter at which angle it is mounted to the hub surface 11. In the same manner, the distal end 13 of the rotor blade is obviously not configured such as to have the smallest possible tip clearance relative to the inner side of the blower pipe 3, no matter at which angle it is mounted to the hub surface 11.

Now, FIG. 5 shows the same rotor blade 5 as is shown in FIG. 4, but wherein the proximal end 14 is configured eg by machining, to the effect that the shape of the proximal end 14 is such that it will snugly adjoin the hub surface 11 of the outer shell 8 on the rotor hub 4.

Following mounting of a number of rotor blades 2 on the rotor hub 4, a fan rotor 2 is thus provided like the one shown in FIG. 6, where the only outstanding matter is that of forming the distal end 13 on each rotor blade 5 such that the right shape is imparted thereto with a view to creating a small tip clearance between the distal end of the rotor blade 5 and the blower pipe 3 as shown in FIG. 1 and such that the rotor 2 is able to precisely rotate freely in the blower pipe 3 without touching same, also in case of high numbers of revolutions.

Thereby it is possible, according to the invention, to provide few constituent components for the manufacture of fan rotors 2 having comparatively high efficiencies and which are both comparatively simple to optimise to specific purposes and do not require elevated production costs for production for storage, etc. It is possible, merely by use of two different constituent components, to produce fan rotors having different rotor diameters and blade angle without this entailing that the efficiency of the fan rotor is reduced significantly.

In this context, however, it will be obvious to the person skilled in the art that it will be possible within the principle of the invention to configure in particular the fan rotor 5 in other ways than the one shown herein. For instance, the hub surface 11 may, as an alternative to the shown paraboloid face, be configured as an ellipsoid face, a conical face, a spherical face or any other essentially rotational-symmetrical face instead.

In the same manner, the rotor blades 5 can be manufactured in a different way than the one shown in the figures, since it is possible to use, instead of the twisted blades 5 shown in the figures, rectilinear blades or blades of another shape.

The invention claimed is:

1. An axial fan comprising:

a circular-cylindrical blower pipe having an internal diameter, wherein the circular-cylindrical blower pipe is configured with a fan rotor, which fan rotor has a rotor shaft which coincides with a centre axis of the circular-cylindrical blower pipe, wherein the fan rotor comprises:

a centrally arranged rotor hub which, via a rotor shaft, is connected to a motor drive, and a number of rotor blades, each of which extends completely or partially radially from the rotor hub and towards the circular-cylindrical blower pipe, wherein each blade has a proximal end secured to the rotor hub, and a distal end at an outer diameter of the rotor which is smaller than an internal diameter of the blower pipe, wherein the rotor hub comprises an outer shell having an outside hub surface which is rotational-symmetrical about the centre axis of the rotor hub; and wherein the rotor hub has a front end and a rear end and a diverging section there between extending from the front end to the rear end of the rotor hub, where a radius of the hub surface in the diverging section is increased by a distance to the front end on the rotor, wherein the rotor hub and the blades are made as separate metal parts; and wherein the rotor blades are securely mounted only to the diverging section on the hub surface, wherein the hub further comprises a shaft part extending within the outer shell along the centre axis of the rotor hub, which shaft part comprises means for mounting of the rotor hub on a dive shaft and being connected to the outer shell at the front end thereof, wherein, for each individual blade on the fan rotor, a first reinforcement rib is configured to extend between the shaft part and the outer shell and to support the outer shell underneath the blade relative to the shaft part, and wherein, for each blade, one or more further reinforcing ribs are configured to extend between the shaft part and the outer shell, to be arranged next to the first reinforcement rib, and to support areas on the outer shell to both sides of the area that is supported by the first reinforcing rib.

2. An axial fan according to claim 1, wherein the blower pipe is provided with mounting flanges both upstream and downstream of said rotor, said mounting flanges extending at right angles to the outside of the blower pipe, said mounting flanges comprising means for mounting the fan rotor in a tubing system.

3. An axial fan according to claim 2, wherein the blades are welded or soldered to the hub surface.

4. An axial fan according to claim 2, wherein the hub further comprises a shaft part extending within the outer shell along the centre axis of the rotor hub, which shaft part comprises means for mounting of the rotor hub on a dive shaft and being connected to the outer shell at the front end thereof; and wherein, for each individual blade on the fan rotor, there is configured a first reinforcement rib extending between the shaft part and the outer shell and supporting the outer shell underneath the blade relative to the shaft part.

5. An axial fan according to claim 1, wherein the blades are welded or soldered to the hub surface.

6. A method of manufacturing a fan rotor, said fan rotor comprising a hub and a number of blades, and wherein the rotor hub has a rotational-symmetrical hub surface; and wherein the rotor hub has a front end and a rear end and a diverging section there between extending from the front end to the rear end of the rotor hub, where a radius of the hub surface in the diverging section is increased by a distance to the front end on the hub, wherein the rotor hub and the blades are first made as separate parts of metal; and wherein each of the rotor blades has a proximal and a distal end; and wherein the proximal end of each blade is subsequently welded or soldered to the hub surface; and wherein, for each blade, a position and an orientation are selected with which the blade is to be welded or soldered to the hub surface, following which the proximal end of each blade is formed and the proximal end is welded or soldered to the hub surface in the selected position, and subsequently each blade is secured by welding or soldering in the respective selected position, and the rotor blades are securely mounted only to the diverging section on the hub surface.

7. A method according to claim 6, wherein a rotor diameter is selected and that the distal end of each blade is configured such that each blade protrudes precisely completely within the selected rotor diameter, seen with centre in the centre axis of the fan rotor.

8. A method according to claim 7, wherein the distal ends of the blades are formed after welding or soldering of the blades to the hub surface in the selected position.

9. A method according to claim 6, wherein hub and blades are made in a molding process.

10. A method according to claim 9, wherein both hub and blades are made substantially of aluminum or of an alloy comprising aluminum.

11. A method according to claim 7, wherein hub and blades are made in a molding process.

12. A method according to claim 8, wherein hub and blades are made in a molding process.

* * * * *